United States Patent [19]

Grosso et al.

[11] Patent Number: 4,690,350

[45] Date of Patent: Sep. 1, 1987

[54] DESPINNING MECHANISM

[75] Inventors: Vincent A. Grosso, Hopkinton; Raymond J. Estlick, Winchester; William A. Zarr, Concord, all of Mass.

[73] Assignee: Raytheon Company, Lexington, Mass.

[21] Appl. No.: 811,039

[22] Filed: Dec. 19, 1985

[51] Int. Cl.[4] ..... F42B 15/02

[52] U.S. Cl. ..... 244/3.1; 102/476

[58] Field of Search ..... 244/3.1; 102/476

[56] References Cited

U.S. PATENT DOCUMENTS

| | | | |
|---|---|---|---|
| 2,623,465 | 12/1952 | Jasse | 102/476 |
| 2,981,188 | 4/1961 | Lipinski et al. | 102/476 |
| 3,225,694 | 12/1965 | Michelson | 102/476 |
| 3,286,630 | 11/1966 | Salmirs et al. | 244/3.1 |
| 3,970,004 | 7/1976 | Suter | 102/476 |
| 4,350,315 | 9/1982 | Pollin | 244/3.1 |
| 4,436,259 | 3/1984 | Schmidt et al. | 244/3.1 |

*Primary Examiner*—Charles T. Jordan

*Attorney, Agent, or Firm*—Philip J. McFarland; Richard M. Sharkansky

[57] ABSTRACT

A despinning mechanism for a shaped charge warhead carried by a spinning projectile is shown to comprise a weight attached to a cord wrapped around such warhead and a release mechanism operative to allow the weight and cord to move radially outwardly from such warhead to impart a decelerating torque on such warhead.

2 Claims, 5 Drawing Figures

DESPINNING MECHANISM

BACKGROUND OF THE INVENTION

This invention pertains generally to spin-stabilized guided projectiles and particularly to a mechanism for despinning a shaped charge warhead intended for use in such projectiles.

A guidance system for a spin-stabalized projectile is described in U.S. Pat. No. 4,347,996 issued to V. A. Grosso on Sept. 7, 1982 and assigned to the same assignee as this application. That guidance system takes advantage of the gyroscopic properties of a spinning projectile to guide the projectile toward a target by maintaining an inertial line-of-sight rate below a preset limit. A plurality of thrusters in helical channels about the periphery of the projectile are activated at appropriate times to cause the projectile to perform the requisite maneuvers to impact.

A so-called shaped charge warhead is a known type of warhead that has superior capability of penetrating armored vehicles under proper conditions. Unfortunately, however, if a shaped charge warhead is used in a rapidly spinning projectile, the efficacy of such a warhead is substantially reduced.

SUMMARY OF THE INVENTION

With the foregoing background of the invention in mind, it is a primary object of this invention to provide a mechanism operable in the terminal phase of flight of the spin-stabilized projectile to despin a shaped charge warhead.

It is another object of this invention to provide a warhead despin mechanism that may sustain high thrust loads associated with the cannon launch environment.

The foregoing and other objects of this invention are generally attained by radially supporting the warhead within the projectile shell by despin bearings disposed at both ends of the warhead. The warhead is radially restrained to the body of the projectile until the terminal phase of flight by a pair of diametrically opposed radial pins that extend from slots in the warhead through the projectile shell and into thruster cavities wherein they are restrained by the thruster covers. The warhead despin is realized through the transfer of the angular momentum of the warhead to linear momentum of a short cord having a weight attached to one end. The cord is initially wound about a pulley provided on the rear of the warhead and the weight is installed within a shell thruster groove and radially restrained by the thruster cover.

In the terminal phase of flight the thrusters covering the radial pins are fired first, thereby allowing the pins to be ejected under the spin forces. Next, the thruster associated with the weight is fired, shearing the cover and allowing the weight to be thrown radially outward. As the weight is payed out the cord unwraps from the pulley and, with angular momentum being conserved, the warhead spins down as the weight is payed out. When the warhead has been completely despun the cord and weight are released into space, thereby discarding the warhead's momentum from the system.

BRIEF DESCRIPTION OF THE DRAWINGS

Other objects and many of the attendant advantages of the invention will be readily appreciated as the same becomes better understood by reference to the following description of the accompanying drawings wherein.

DESCRIPTION OF THE PREFERRED EMBODIMENT

Figure 1A:
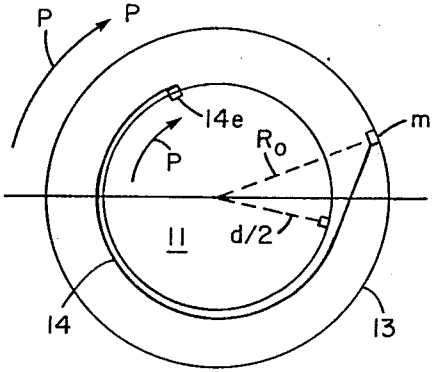
FIGS. 1A, 1B and 1C are sketches useful in understanding the principle of operation of the contemplated despin mechanism.
Figure 1B:
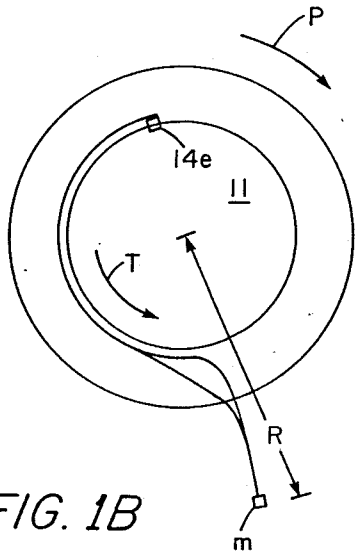

Referring now to FIGS. 1A and 1B, it may be seen that the operation of the contemplated despin mechanism is based on the principle of conservation of angular momentum. Thus, as illustrated in FIG. 1A, it may be seen that initially a warhead 11, a projectile 13, a weight m and a cord 14 are assembled to rotate as a unitary body at an angular rate P, clockwise. The weight m is positioned near the outside of the projectile 13 with the cord 14 wrapped around the warhead 11 to a point 14*e*. In the initial condition, i.e., before the terminal phase of flight, total angular momentum, $h_1$, may be expressed as:

$$h_1 = I_1P + I_2P + m\,R_O^2P \qquad \text{(Eq. 1)}$$

where $I_1$ moment of inertia of the warhead 11, $I_2$ is the moment of inertia of the projectile 13, $R_O$ is the radial distance of the weight m (in slugs) from the center of the projectile 13, and the mass of the cord 14 is neglected.

It may be seen in FIG. 1B that after the weight m has been allowed to move outwardly from the projectile 13 (in a manner to be described hereinafter) the angular rate of the warhead 11 decreases. When the total angular momentum, h, (assuming the angular rate P of the projectile 13 to be constant and the mass of the cord 14 to be negligible) may be expressed as:

$$h_2 = I_1(o) + I_2P + m\,R^2p \qquad \text{(Eq. 2)}$$

where R is the radial distance of the weight m from the center of the projectile 13. By virtue of the principle of conservation of angular momentum Eqs. (1) and (2) may be equated to yield:

$$I_1P + I_2P + m\,R_o^2P = I_1(o) + I_2P + m\,R^2P \qquad \text{(Eq. 3)}$$

Eq. (3) may be reduced to the following:

$$R = [(I_1/m) + R_o^2]^{1/2} \qquad \text{(Eq. 4)}$$

which represents the length of the cord 14 when the warhead 11 is decelerated from the initial rate, P, to an angular rate of zero.

Figure 1C:
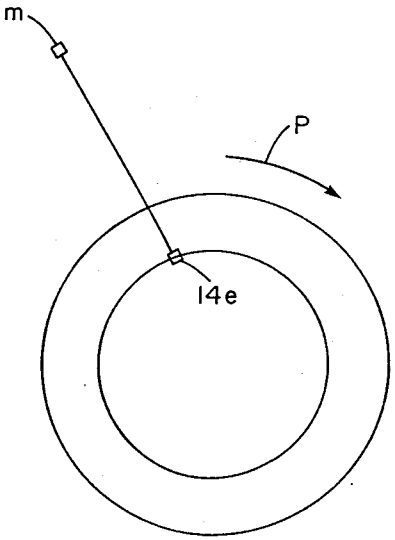

It may be seen in FIG. 1C that after the projectile 13 has rotated so that the cord 14 is completely unwrapped from around the warhead 11 and the point 14*e* is aligned with the weight m, the extant centrifugal force causes the mass m and the cord 14 to separate from the projectile 13 and the warhead 11.

Figure 2:
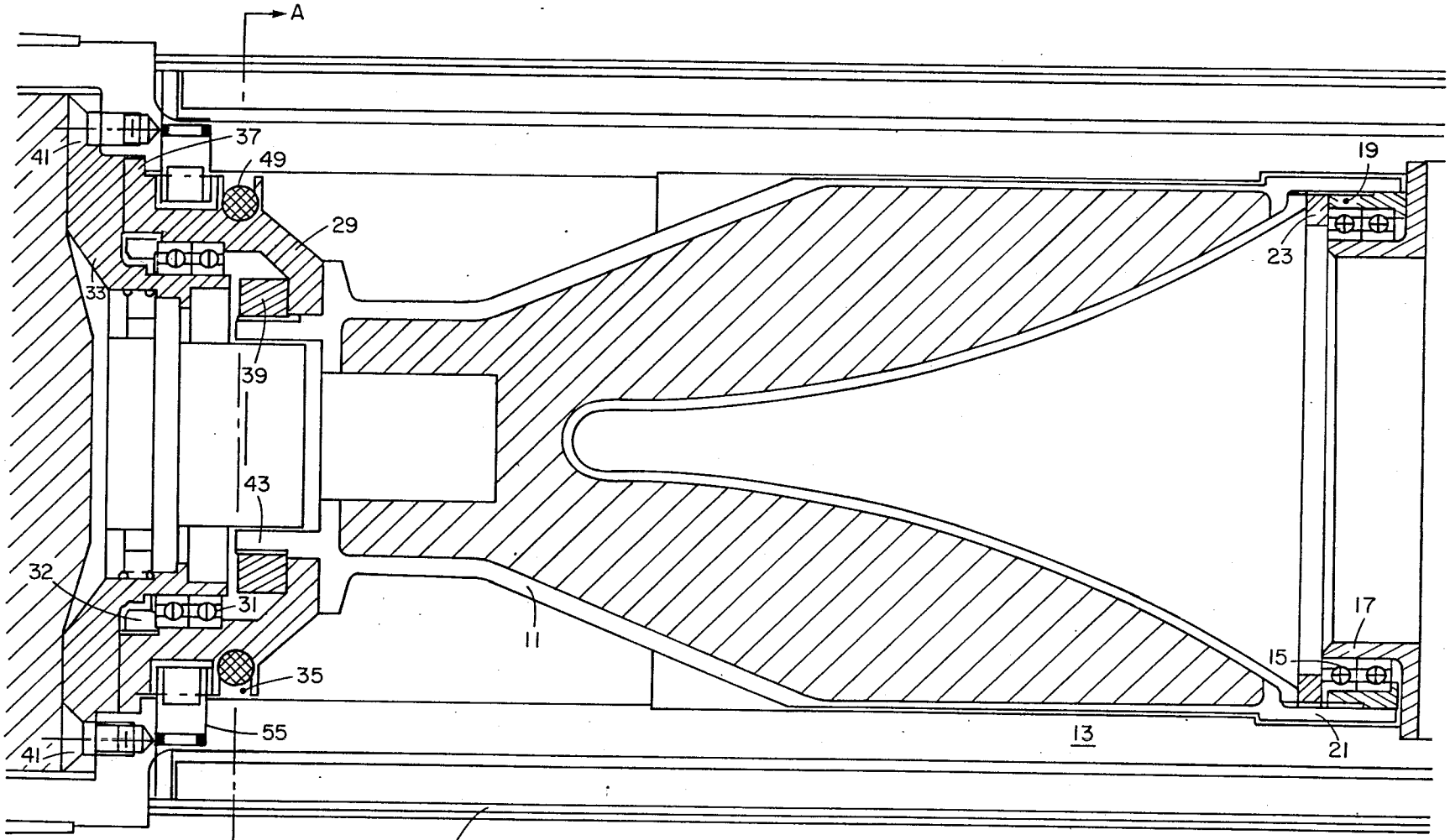
FIG. 2 is a simplified longitudinal cross-sectional view of a spin-stabilized projectile having a warhead despin mechanism according to this invention.
Figure 3:
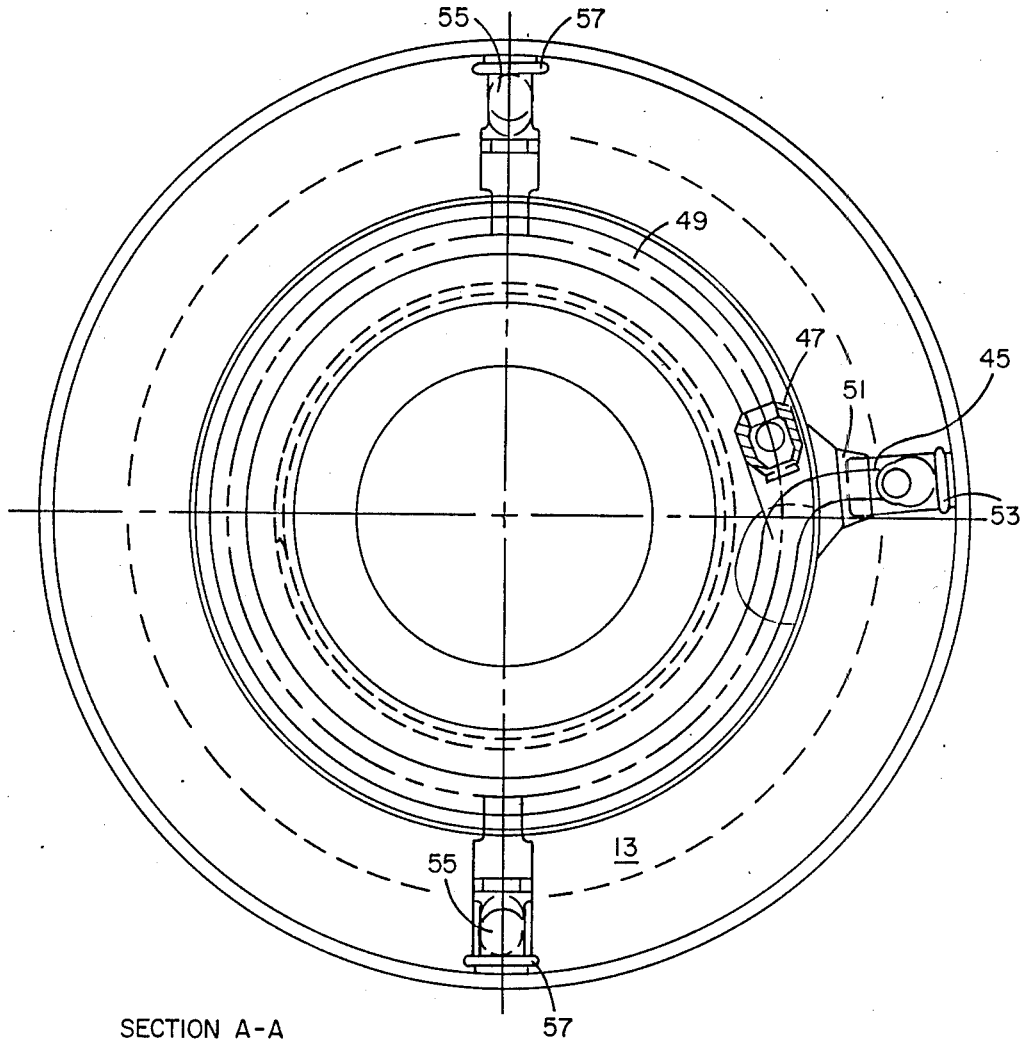
FIG. 3 is a simplified end view, taken along line A—A of FIG. 2, illustrating how the contemplated despin mechanism is disposed within the spin-stabilized projectile of FIG. 2.

Referring now to FIGS. 2 and 3, it may be seen that the warhead 11 (here a shaped charge) is disposed within the projectile 13 in such a manner that, initially, the warhead 11 is shown to be supported within the projectile 13 by a bearing assembly (not numbered) comprising a duplex bearing 15, and inner race support ring 17, and an outer race support ring 19. Outer race support ring 19 is then threaded into a collar 21 on the forward end of the warhead 11 into contact with a retaining ring 23. The inner race support ring 17 is supported integrally with the projectile 13.

The aft end of the warhead 11 is affixed to a despin assembly (not numbered) comprising a warhead base fitting 29, despin bearings 31 and an aft bearing support plate 33. The despin bearings 31 (which are similar to the bearing assembly just described) and retainer ring 32 are assembled into the warhead base fitting 29 with their inner races supplemented by the aft bearing support plate 33. The base fitting 29 is held in place by a warhead threaded retainer ring 39, as shown. A groove 35 is formed on the warhead base fitting 29 to accommodate a cord 14 (here a $\frac{1}{4}$ inch cord of Kelvar, a synthetic material supplied by Samson Cordage, 99 High Street, Boston, Massachusetts). One end of the cord 49 is affixed to a weight 45 and the other end to a fitting 47 engaging a socket (not shown) in the groove 35. The cord 49 is wrapped around the warhead base fitting 29 in the groove 35. The direction of winding of the cord is opposite to the direction of rotation of the projectile 13 in flight. Initially, the fitting 47 is in the groove 35 and the weight 45 is in one of the thruster openings (not numbered) in the projectile 13. The cover 53 over the thruster opening then restrains the weight 45. Radial pins 55 within other thruster openings (not numbered) project into complementary openings (not numbered) in the warhead base fitting 29, such radial pins being held in place by the associated covers 57 of the thruster openings.

It will now be appreciated that, with the covers 53, 57 in place as shown, the pins 55 lock the projectile 13, the warhead 11, the weight 45 and the cord 49 together into a unitary spinning structure. When, however, the covers 53, 57 are displaced during the terminal phase of flight (as by the force of explosion of the associated thrusters (not shown) in response to actuating signals derived in any convenient manner), the pins 55 are thrown free and the weight 45 is also thrown free because of centrifugal forces. The warhead 11 then is free to rotate relative to the protectile 13. As such relative rotation occurs, the weight 45 and the cord 49 and fitting 47 combine to translate the centrifugal force into a torque on the warhead 11 to decelerate the warhead 11 as desired. The cord 49 is unwound, finally being separated from the groove 35 and passing outwardly through the thruster opening in the projectile 13 in which the weight 45 was originally located. The decelerating torque on the warhead 11 then disappears, leaving the warhead 11 without any substantial rotational movement even though the projectile 13 continues to spin. It will be appreciated now that the size of the weight 45 and the length of the cord 49 may be determined for any given warhead by application of the formulas given hereinbefore.

Having described a preferred embodiment of the invention, it will now be apparent to one of skill in the art that other embodiments incorporating its concept may be used. It is felt, therefore, that this invention should not be restricted to the disclosed embodiment, but rather should be limited only by the spirit and scope of the appended claims.

What is claimed is:

1. In a spinning projectile carrying a shaped charge warhead, an arrangement for despinning such warhead during the terminal phase of flight of such projectile, such arrangement comprising:

(a) first means disposed between the spinning projectile and the shaped charge warhead for mounting such warhead within such projectile, the first means comprising:

(i) a pair of journal bearings disposed between the spinning projectile and the shaped charge warhead;

(ii) locking means disposed between the spinning projectile and the shaped charge warhead for inhibiting relative rotational movement between such projectile and warhead;

(b) second means for effectively increasing the moment of inertia of the shaped charge warhead whereby the speed of rotation of such warhead is reduced substantially to zero radians per unit time; and (c) means, operative during the terminal phase of flight, for removing the locking means then to allow relative movement between the spinning projectile and the shaped charge warhead.

2. The improvement as in claim 1 wherein the second means comprises:

(a) a groove formed around the periphery of the shaped charge warhead;

(b) a cord having the greater part of its length initially wrapped around the shaped charge warhead in a direction opposite to the direction of rotation of the spinning projectile;

(c) a weight affixed to the free end of the cord, such weight being positioned initially adjacent the periphery of the spinning projectile;

(d) means for releasing the weight to allow such weight to move outwardly from the spinning projectile and the shaped charge warhead to impart a deceleratilng torque to such warhead.

* * * * *